US006899049B2

(12) United States Patent
Gehring

(10) Patent No.: US 6,899,049 B2
(45) Date of Patent: May 31, 2005

(54) APPARATUS AND METHOD OF CONSTRUCTING OFFSHORE PLATFORMS

(76) Inventor: Donald H. Gehring, 14690 Old Conroe Rd., Conroe, TX (US) 77384

( * ) Notice: Subject to any disclaimer, the term of this patent is extended or adjusted under 35 U.S.C. 154(b) by 0 days.

(21) Appl. No.: 10/696,446

(22) Filed: Oct. 29, 2003

(65) Prior Publication Data

US 2005/0092226 A1 May 5, 2005

(51) Int. Cl.[7] ..... B63B 35/44
(52) U.S. Cl. ..... 114/264; 441/5; 114/253
(58) Field of Search ..... 441/4, 5; 114/293, 114/264

(56) References Cited

U.S. PATENT DOCUMENTS

| | | | | |
|---|---|---|---|---|
| 2,104,053 | A | 1/1938 | Odenbach et al. | |
| 3,974,789 | A | 8/1976 | de Groot | |
| 4,511,288 | A | 4/1985 | Wetmore | |
| 4,701,143 | A * | 10/1987 | Key et al. | 441/5 |
| 4,702,321 | A | 10/1987 | Horton | |
| 4,938,630 | A | 7/1990 | Karsan et al. | |
| 5,189,975 | A | 3/1993 | Zednik et al. | |
| 5,435,262 | A | 7/1995 | Grinius et al. | |
| 5,651,709 | A * | 7/1997 | Nandakumar et al. | 441/5 |
| 5,833,397 | A | 11/1998 | Horton, III | |
| 5,899,162 | A | 5/1999 | Beaupre et al. | |
| 5,909,715 | A | 6/1999 | Menon | |
| 6,092,483 | A * | 7/2000 | Allen et al. | 114/264 |
| 6,125,780 | A | 10/2000 | Sweetman et al. | |
| 6,230,645 | B1 | 5/2001 | Chow | |
| 2002/0067956 | A1 | 6/2002 | Cottrell | |
| 2002/0139286 | A1 | 10/2002 | Lee et al. | |

FOREIGN PATENT DOCUMENTS

| | | |
|---|---|---|
| JP | 59032578 | 2/1984 |

* cited by examiner

*Primary Examiner*—Jesus D. Sotelo
(74) *Attorney, Agent, or Firm*—Bracewell & Patterson, L.L.P.

(57) ABSTRACT

A deep-water floating offshore platform includes a buoyant hull having a substantially flat top, and substantially flat bottom, and a plurality of substantially flat sides. The hull further includes a tendon access shaft and a plurality of riser guide sleeves. The tendon access shaft extends below the bottom of the hull and includes a counterweight connected to the lower portion of the tendon access shaft to provide stability to the hull. The hull can be constructed from a cargo tank section of an existing oil tanker or through the use of new construction based on using the flat-plate design used in constructing cargo tank sections of oil tankers.

24 Claims, 5 Drawing Sheets

APPARATUS AND METHOD OF CONSTRUCTING OFFSHORE PLATFORMS

BACKGROUND OF THE INVENTION

1. Field of the Invention

The present invention relates generally to floating offshore platforms. In more specific aspects, the present invention relates to multi-sided floating offshore platforms and methods for constructing such platforms, associated therewith.

2. Description of the Related Art

Offshore platforms are used for processing well fluid from subsea wells. Early offshore structures were supported from the bottom or sea floor. Sea floor supported platforms are still often used in shallow water. When the wells are depleted, however, most governments require that the structure be removed. These bottom supported platforms, being embedded in the sea floor, are not reused, but rather are scrapped at considerable expense after one use. The removal costs are particularly high because these platforms are normally too large to be lifted out of the water, and therefore must be cut up and dumped in approved offshore deep water dumping sites.

Floating offshore platforms are utilized in deeper water. One type of device that has been developed for use in deep and ultra deep water is a deep draft cassion vessel, also known as a spar platform. Such spar-type platforms generally have an elongate cassion hull having an extremely deep kneel draft typically greater than 500 feet. The spar supports an upper deck above the ocean surface and is moored using catenary anchor lines attached to the hull and to seabed anchors. Risers generally extend down from a moon pool in the hull of the spar platform to the ocean floor. The hull of the typical spar platform is generally cylindrically shaped, typically formed of a large series of curved plates positioned in a circular fashion and having a perpendicular radial plane which passes through the isocenter of the hull to form a cylindrical structure. This cylindrical design is used to reduce the severity of the shedding of vortices caused by the ocean currents and to more efficiently resist the hydrostatic pressures. These deep water floating platforms are very costly, usually over $40 million, thus, their use has been restricted to generally only large offshore field developments. Recognized, therefore, is the need for an inexpensive method of constructing such offshore floating platforms. Recognized also is that flat-panel oil tanker-type construction, whether from new construction or through use of existing oil tankers, which can be built in a low-cost tanker shipyard is the lowest cost per ton type of hull construction.

In the not too recent past, oceanic shipments of oil were made primarily in single-skin tankers. In the typical tanker design, mid-ship cargo sections of the tanker are divided by longitudinal and transverse bulkheads into a series of port and starboard side tanks and a center tank. The outer hull plating of the ship forms the outer shell of the side tanks. Similarly, the bottom plating forms the lower shell of the central tanks. Thus, no ballast tanks, void spaces or the like are present between the hull plating and the tanks containing the oil. The defect of such "single-skin" tankers is that any damage to the hull will typically cause the oil in the corresponding tanks to leak, possibly causing damage to coastlines, wildlife, and fisheries. Increasing public awareness of this defect in single-skin tankers and of the fragile nature of the Earth's ecosystem has resulted in substantial worldwide attention to the use of single-skin tankers. Correspondingly, many single-skin oil tankers are going to the scrap yard prematurely, not because they are old, but because they are single-skinned. A fear of many Americans is that a single-skinned oil tanker will run aground like the Exxon Valdez did and will cause billions of dollars of damage to the environment and will ruin tourist beaches. The resulting damage to the economy can be enormous. The United States has thus mandated the phase out of single-skinned tankers in U.S. waters. Other countries are also following the United States lead. The result is a lot of oil tankers are heading to the scrap yards that have good condition oil cargo tanks.

Since an oil tanker carries oil in the cargo tanks and since all the cargo tanks are usually filled and emptied at the same time, the internal surfaces of the oil tankers are almost always coated with oil or an oil film, protecting them from corrosion. A nitrogen blanket is also kept on top of the oil in the tankers protecting all internal surfaces of the oil tanker above the oil from corrosion. The companies that own these tankers usually keep the external coatings on these tankers to a high standard and keep external corrosion to a minimum. The resulting steel on these oil tankers is usually in excellent condition and that steel can serve for many more years as an offshore platform. The scrap value of a very large single skin oil tanker today would be from $5 to $10 million. Double sided and double bottomed oil tankers may also be a good candidate for conversion since they might not need additional internal water tight bulkheads, but they may be as expense to convert as new construction.

SUMMARY OF THE INVENTION

In view of the foregoing, an embodiment of the present invention advantageously provides a multi-sided floating offshore platform and methods of constructing such platform. The multi-sided floating offshore platform includes a buoyant hull generally formed either from a cargo tank section of an existing oil tanker or from new construction based on oil tanker cargo tank flat-panel design. The hull has a nearly flat top, and substantially flat bottom, and a plurality of substantially flat sides.

The bottom of the hull includes a first aperture positioned substantially in a central portion of the bottom of the hull to thereby define a first tendon access shaft aperture and a plurality of smaller apertures positioned in a surrounding relationship to the first tendon access shaft aperture to thereby define a plurality of bottom riser slot apertures. The top of the hull includes a second aperture positioned substantially in a center portion of the top of the hull to thereby define a second tendon access shaft aperture, and a corresponding plurality of smaller apertures positioned in a surrounding relationship to the second tendon access shaft aperture to thereby define a plurality of top riser slot apertures. The second tendon access aperture is positioned in a matching axial relationship with the first tendon access shaft. The plurality of top riser slot apertures are positioned in a matching axial relationship with the plurality of bottom riser slot apertures.

The hull of the multi-sided floating offshore platform includes a conduit having an upper portion and a lower portion that extends from below the bottom of the hull and through the first and second tendon access shaft apertures to thereby define a tendon access shaft. The upper portion of the tendon access shaft is cooperatively engaged with the hull to provide access to a tendon. The lower portion of the tendon access shaft can include a tendon access shaft extension of a selectable length, the length selected depending upon the stability requirements for the hull. The hull further includes riser guide sleeves positioned between the top riser slot apertures and bottom riser slot apertures to provide passage or support to a plurality of risers. The bottom of the hull is sealed about the riser guide sleeves, the bottom riser slot apertures, and the first tendon access shaft to provide additional buoyancy to the buoyant hull.

The multi-sided floating offshore platform preferably includes a counterweight connected to the lower portion of the tendon access shaft to provide a righting moment and additional stability to the hull. The counterweight can have riser conductor slots to provide lateral stability to a plurality of risers. The conductor slots of the counterweight can be connected to the risers to support a vertical load of the risers, which has the effect of providing additional vertical stability to both the offshore platform and to the risers.

BRIEF DESCRIPTION OF THE DRAWINGS

So that the manner in which the features, advantages and objects of the invention, as well as others which will become apparent, are attained and can be understood in more detail, a more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 9:
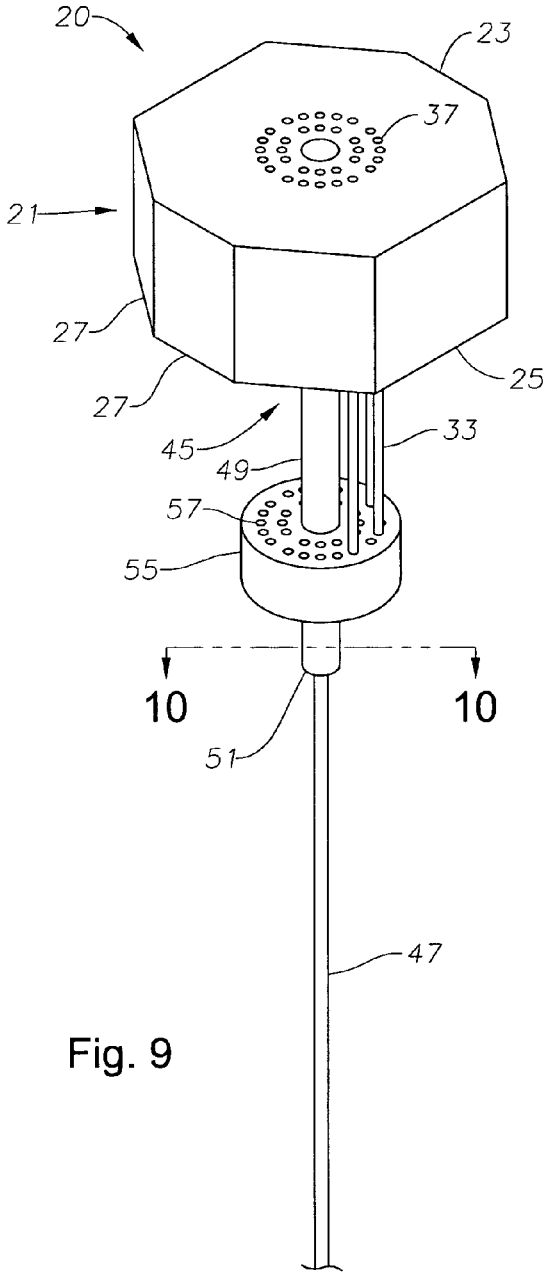
FIG. 9 is a perspective view of the hull shown in FIG. 8 having additional stability options according to an embodiment of the present invention.

A oil tanker is a very stable flotation platform and so are a plurality of individual cargo tanks that form the tanker since the width of each cargo tank is greater than its depth. Thus, a cargo tank section removed from the tanker would also be inherently stable and can form the basis of a new hull design for a multi-flat sided floating offshore platform. Referring to FIG. 9, shown is a hydrodynamically improved deep water multi-flat sided floating offshore platform 20 including a buoyant hull 21 having a nearly flat top 23 forming a deck, a substantially flat bottom 25, and a plurality of substantially flat sides 27 constructed in accordance with an embodiment of the present invention (described later). The top 23 of the hull 21 can be best described as nearly flat because the top 23 is preferably made of flat panels that are connected with a slight slope to allow water drainage. The buoyant hull 21 can be formed from a plurality of existing adjacent intact oil tanker cargo tanks sections 31 from an existing oil tanker 30 (FIG. 1) or from new construction based on the flat-panel design used in oil tankers 30 (described later).

Figure 6:
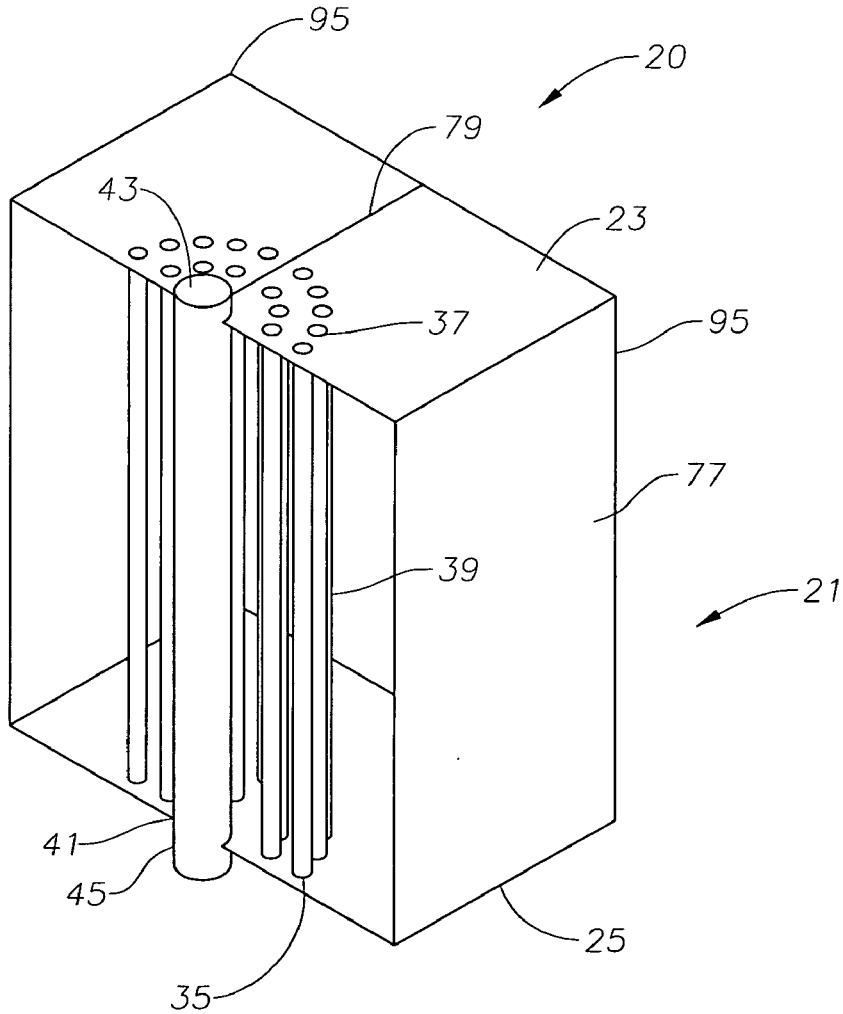
FIG. 6 is a perspective sectional view of a hull according to an embodiment of the present invention.
Figure 8:
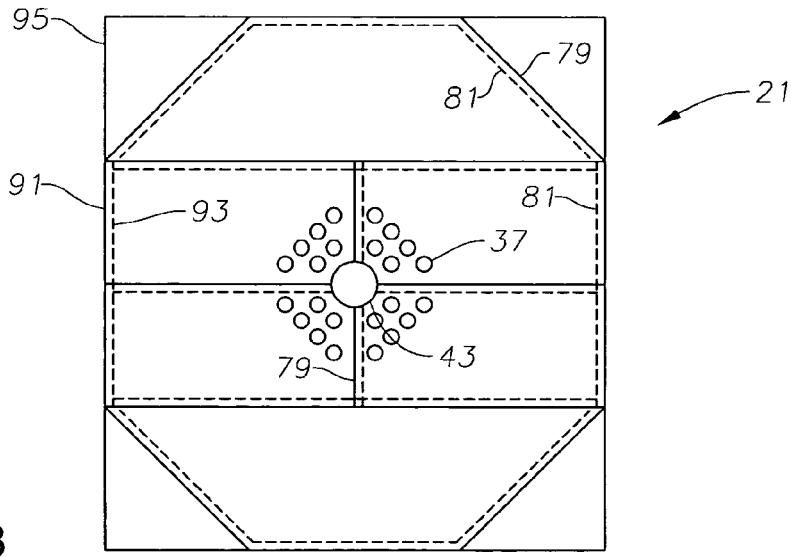
FIG. 8 is a plan view of the hull shown in FIG. 6 having additional hydrodynamic improvements according to an embodiment of the present invention.

Referring to FIGS. 6, 8, and 9, in most embodiments of the present invention, as with nearly all floating offshore platforms, the platform 20 provides for access for a plurality of risers 33. A plurality of riser slot apertures 35 are positioned in a generally circular fashion about the center area of the bottom 25 of the hull 21, which allow passage of a corresponding plurality of risers 33 through the hull 21. Another plurality of top riser slot apertures 37 are also positioned in a generally circular fashion about a center area of the top 23 of the hull 21, which allow passage of the plurality of risers 33 to the deck or top 23. The top riser slot apertures 37 are positioned in a matching axial relationship with the bottom riser slot apertures 35 to allow passage of risers 33 to the deck or top 23. Riser guide sleeves 39 can be positioned between the top riser slot apertures 37 and the corresponding bottom riser slot apertures 35 to provide guides for the positioning of the risers 33. At least the bottom 25 of the hull 21 is preferably sealed about a lower section of the riser guide sleeves 39 to prevent a loss of buoyancy for the entire compartment or compartments affected by forming the bottom riser slot apertures 35 for the riser guide sleeves 39.

In an embodiment of the present invention, the multi-flat sided floating offshore platform 20 can include provisions for being tendon moored at a site location. As such, referring to FIG. 6, the bottom of the hull can include a first aperture 41 positioned substantially in a central portion of the bottom 25 of the hull 21. Correspondingly, the top 23 of the hull 21 includes a second aperture 43 positioned substantially in a center portion of the top 23 of the hull 21. The first and second apertures 41, 43, can allow either tendon access for tendon visualization from either the top 23 of the hull 21 or from a point within the hull 21.

Referring to FIG. 6, a column or conduit having an upper portion and a lower portion, preferably extends from below the bottom 25 of the hull and through the first and second apertures 41, 43, to thereby define a tendon access shaft 45. The upper portion of the tendon access shaft 45 cooperatively engages with the hull 21 to provide access to a tendon or tendons 47 (FIG. 9). The tendon access shaft 45 can provide access for tendon installation and removal and can also support the connection of one or more tendons used to moor the hull 21 to its site-specific location. At least the bottom 25 of the hull 21 is preferably sealed about the tendon access shaft 45 to prevent a loss of buoyancy for the entire interior compartment or compartments affected by forming the first aperture 41 for the tendon access shaft 45. The tendon shaft 45 is further supported by additional vertical bulkheads 79.

Figure 10:
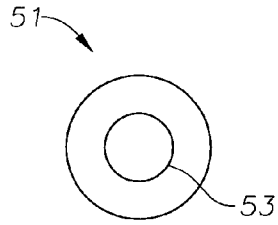
FIG. 10 is a plan view taken along the 10—10 line of a tendon axis shaft extension according to an embodiment of the present invention.

Referring again to FIG. 9, the tendon access shaft 45 can include a tendon access shaft extension 49 extending below the bottom 25 of the hull 21 to provide the connection of the one or more tendons 47. The tendon access shaft extension 49 can be part of a unitary tendon access shaft or a separate component attached to the tendon access shaft. The body of both the tendon access shaft 45 and tendon access shaft extension 49 can be formed in a variety of geometric shapes but are preferably of a cylindrical or square form. The tendon access shaft 45, which may or may not include the tendon access shaft extension 49, can include a tendon connector 51 (FIG. 10) having a tendon connection aperture 53 for connecting a single tendon to the tendon access shaft 45. Alternatively, the tendon access shaft can instead include a tendon connector 51' (FIG. 11) having a plurality of tendon connection apertures 53' for connecting a plurality of tendons 47 to the tendon access shaft 45. The tendon connection apertures 53 can support rigid fixed tendons, tendons with flex joints or revolving turret mounted tendons. The tendon or tendons 47 can be made of many types of material including steel and many types of structure shapes including pipe, rope or chain. The tendon 47 can be either buoyant, non-buoyant, or partially buoyant and still be within the scope of the present invention.

Referring to FIG. 9, a counterweight 55 can be added below the buoyant hull 21 to provide additional stability. The counterweight 55 can be connected to the lower portion of the tendon access shaft 45. The tendon access shaft 45, in conjunction with counterweight 55, can provide an additional righting arm. The resulting attachment of a counterweight 55 and/or tendon 47 to the lower portion of the tendon access shaft 45 will significantly increase the overturning moment resistance of the platform 20 and significantly increase the stability of the hull 21. The size of the counterweight 55 and the length of the tendon access shaft 45 can be selected such that the counterweight 55 can provide adequate free floating stability of the platform 20 in the event of complete tendon failure. The counterweight 55 can include a plurality of riser conductor slots 57 to also provide lateral stability to the risers 33. The riser conductor slots 57 of counterweight 55 can allow the risers 33 to freely pass or can be connected to the risers 33 to provide lateral and/or vertical load support for the risers 33. Additionally, the risers 33 may be either tensioned at their top or bottom to provide additional vertical stability to the offshore platform 20 and provide a requisite tension to the risers 33. In an embodiment of the present invention, the tendon access shaft 45 can sufficiently extend the distance of the counterweight 55 from the bottom 25 of the hull 21 to provide additional stability to the platform 20, even with the deck on top, such that the platform 20 can be floated vertically to a site location without the need of additional support or a separate offshore deck lift.

Another embodiment of the present invention improves stability by connecting a plurality of compartments 61 (FIG. 12) such as those shown at the lower end of the buoyant hull 21'. The compartments 61 can be added externally below the original bottom 25' of hull 21'. Additionally, if new construction methods are used, the sides 27' of the buoyant hull 21' can be constructed to allow the deeper draft than could be attained from using cargo tank sections 31 from an existing oil tanker 30. The specification internal compartments can be elongated and sub-divided in order to form internal compartments 61.

Figure 7:
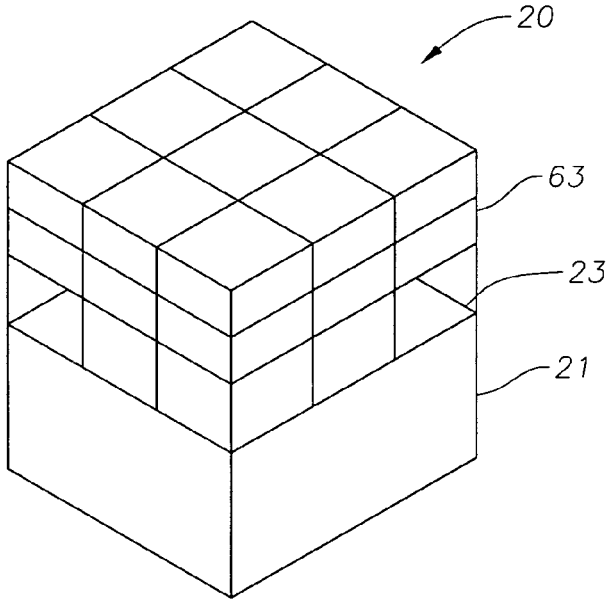
FIG. 7 is a perspective view of the hull of FIG. 6 mounted with a deck according to an embodiment of the present invention.

Stability can also be further enhanced by housing drilling equipment and process equipment (not shown) inside the hull 21 to lower the vertical center of gravity of the platform 20. Note, the first tension leg platform "TLP" was used in the North Sea and had a completely enclosed deck except in the wellbay area. The deck was ventilated to remove hydrocarbon gases and the deck worked successfully until the field was depleted and the platform was removed. In this embodiment, the same accomplishment can be achieved by using the large inside area of the former oil tanker cargo tank section compartments no longer to be used for oil storage. Some of the drilling equipment and related items that could be located in the hull 21 to perform this function include drilling liquids, pumps, pneumatic-tanks, drilling power, and sack storage. With utilization of the internal compartments of the hull 21, the upper deck 63 (FIG. 7) of the platform can be reduced to that of a single level. That one deck level could be used to support equipment normally occupied by personnel such as: the drilling rig, accommodation/helideck building, motor control center (MCC), flare, cranes and ventilation system with the normally unoccupied process space located in the hull 21.

As stated above, the buoyant hull 21 of the multi-flat sided floating platform 20 can advantageously be constructed from such a section 31 (see FIG. 1) of an existing oil tanker 30 or can be from newly constructed materials based upon flat panel oil tanker type construction. Particularly, the design of the hull 21 can advantageously be based on the proportions of the oil tanker from which the hull or hull design was taken.

Figure 1:
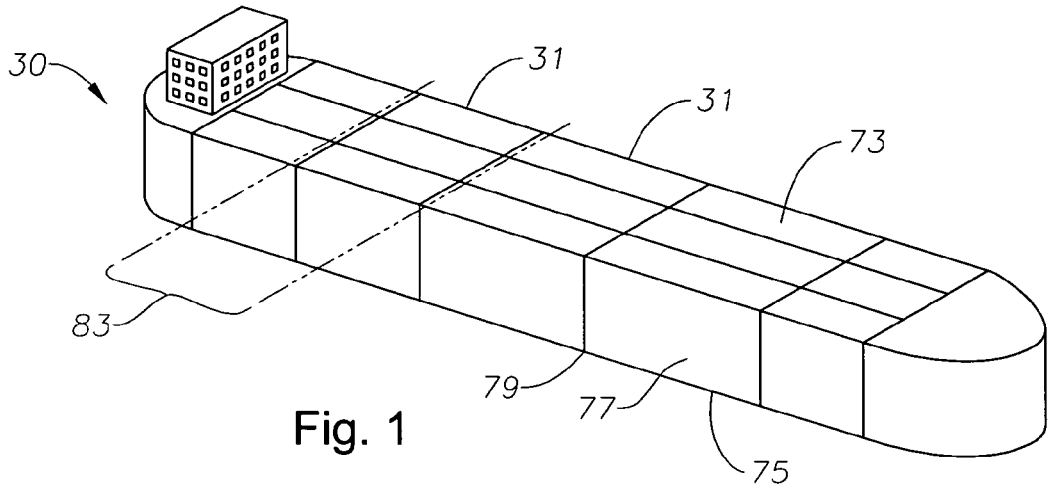
FIG. 1 is a perspective view of an example oil tanker showing a possible location to vertically cut the existing tanker to remove a cargo tank section intact according to an embodiment of the present invention.
Figure 2:
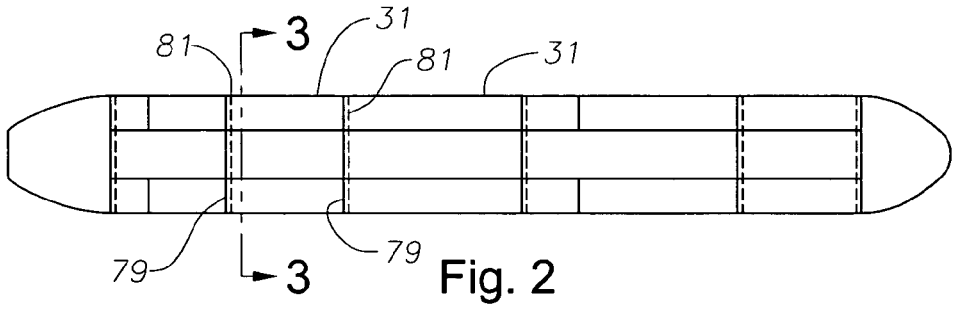
FIG. 2 is a plan view of the tanker shown in FIG. 1, indicating the side of the watertight bulkheads having a stiffener.

Referring to FIG. 1, shown is an example oil tanker 30 having a plurality of cargo tank sections 31, each subdivided into individual compartments 71, and from which the hull 21 can be constructed. When constructed from an existing oil tanker 30, the hull 21 can make use of the tanker top decks 73, tanker bottoms 75, tanker side shells 77, and pre-existing tanker vertical internal watertight bulkheads 79 to inexpensively construct the multi-sided floating offshore platform 20. Referring to FIG. 2, each cargo tank section 31 is divided from the next cargo tank section 31 by watertight bulkheads 79. Each watertight bulkhead 79 (dividing wall) of each cargo tank section 31 includes stiffeners 81, typically only on one side with the opposite side being a smooth flat surface. The stiffeners 81 provide each cargo tank section 31 sufficient structural integrity when void and with the oil tanker 30 at maximum draft. Oil tankers and floating offshore platforms must resist similar environmental conditions. Thus, each cargo tank section 31 can serve as the basis for construction of the new buoyant hull 21. In this embodiment of the present invention, preferably primarily only intact cargo tank sections 31 of the existing oil tanker 30 should be used to form the base structure of the new hull 21. Use of near intact cargo tank sections 31, rather than merely cutting individual flat panels from the existing oil tanker 30, saves new material and labor costs. Some of the existing oil tanker equipment could also possibly be reused. For example, generators, electrical equipment, instrumentation, communication equipment, pumps, valves, lifeboats, rafts, safety systems, the MCC, accommodation block and the control room, are all examples of equipment that may be reused. Equipment such as the existing crude oil pumping system could also be converted to use as a ballast system.

Figure 3:
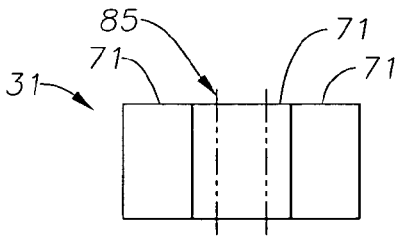
FIG. 3 is a front elevational view of an intact cargo tank section taken along the 3—3 line of FIG. 2.

One of the intact cargo tank sections 31 can be removed from the oil tanker 30 to be formed into the new hull 21 for the multi-flat sided offshore oil platform 30. Referring again to FIG. 1, shown are dashed lines 83 depicting a possible location to vertically cut outside the bulkheads 79 of one of the mid-section intact cargo tank sections 31 positioned therebetween and which will allow intact removal of that cargo tank section 31. The removal operation results in a cargo tank section 31 that is then three compartments 71 in width by one compartment in length (FIG. 3), generally measuring typically 53.6 M×42 M. The cargo tank section 31 should normally be selected and the cuts made such that the removed cargo tank section 31 is buoyant, stable, and capable of being floated freely on its own for transportation across the harbor or potentially across the world to a drydock or to a heavy-lift transport vessel. Particularly, the removed tanker midsection 31 should be rendered movable to a conversion yard where most of the conversion work could be carried out while the hull 21 is floating or while the hull 21 is in a drydock. In some instances, however, the hull 21 may need to go into drydock again or may remain in the initial drydock if further below water openings and/or closures (described in more detail later) are needed.

Figure 4:
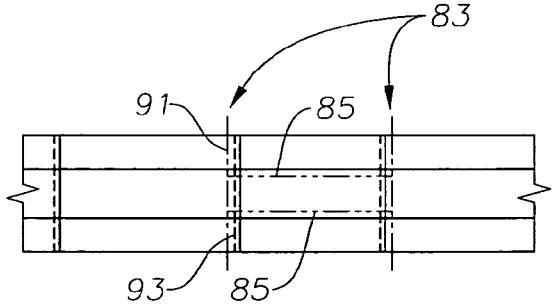
FIG. 4 is a sectional plan view of a section of the example tanker shown in FIG. 1 showing additional cut lines.

In an embodiment of the present invention, the hull 21 is preferably cut into the shape of an equilateral quadrilateral or box section hull, such as that shown in FIG. 6, preferably measuring approximately 42 M×42 M. Referring to FIG. 4, the selected cargo tank section 31 can be further divided in order to remove preferably a central 11.6 M section of the selected cargo tank compartment 71. In the preferred embodiment, the central compartment 71 of the selected cargo tank section 31 is cut vertically as shown by the dotted line in FIGS. 3 and 4. These additional cuts 85 can be performed on the selected cargo tank section 31 either prior to or after removal from the remaining portion of the oil tanker 30. The timing selection decision is typically made depending upon whether the cargo tank section 31 is to remain in drydock or must be immediately transported to another location. The location of tanker cuts 83, 85, should be planned to maximize the number of smooth external flat plate surfaces left in oil tanker 30, to allow correct re-alignment of the rejoined sections, to minimize re-welding and still to allow near intact removal of cargo tank section 31.

Figure 5:
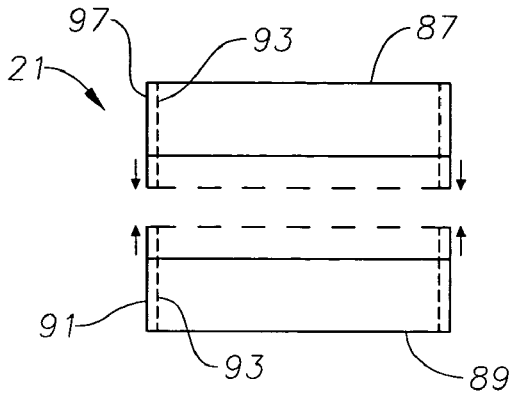
FIG. 5 is a plan view of a pair of sections of a cargo tank section removed from the tanks of FIG. 1 prior to being joined to form a hull.

Referring to FIG. 5, regardless of which timing selection was made, the two sections 87, 89, formed by the cuts 83, 85, are then rejoined to form the new buoyant hull 21, in our example measuring 42 M×42 M. Additionally, the watertight bulkhead located at 91 (FIG. 4) needs to be reversed so that its stiffeners 93 are on the inside of the resulting hull 21 as shown in FIG. 5. Additionally, the bulkhead 91 and stiffeners 93 should be aligned and re-welded to surrounding stiffeners to provide sufficient structural integrity. In fact, as a general rule, all external vertical bulkheads 79 that are repositioned, such as those described above, should be cut free, rotated 180 degrees, and re-welded so that their stiffeners, strainers, and girders will be internal. The panels including bulkheads that have been cut should be trimmed and re-welded to make watertight compartments within hull 21. Whether or not a specific watertight bulkhead 79 need be reversed to place the bulkhead stiffeners 81 internal and make the exterior of the hull 21 smooth and stiffener-free depends on which of the plurality of cargo tank sections 31 of the oil tanker 30 is selected for new hull formation. As stated, generally, the selection should be made in order to make maximum use of intact tanker hull material and in order to minimize required use of the new steel materials and minimize re-welding. Additionally, as stated, any side shells 77 that are cut from the oil tanker 30 and relocated should have their stiffeners 81 and plate girders aligned with the existing surrounding stiffeners and plate girders and re-welded.

Because the new hull has a depth equal to at least that of the original tanker 30 from which it was made or from which it was designed, by ballasting the hull 21 to have the same draft as the original oil tanker maximum draft, stiffeners and plating of the existing tanker 30 generally should not need to be replaced or additional strengthening added. Exposed uncoated tanks, however, should be cleaned, shot ballasted and painted for corrosion protection and anodes added to surfaces that will float below water level. Hull appurtenances can be added as would be done for any conventional floating offshore platform hull. Various configurations of decks 63, for example, such as that shown in FIG. 7, can be mounted atop the new hull 21 to form the multi-flat sided floating offshore platform 20.

The above described hull construction methodology advantageously provides efficient use of a tanker construction facility. After the selected cargo tank section 31 is removed, the remaining cargo tank sections 31, ends of the tanker, and the removed cargo tank sections of the tanker 30 can be floated free from each other out of the drydock, as desired. The remaining ends of the tanker can be rejoined in the drydock, and towed separately to the scrap yard or towed to a storage location for future use as another offshore platform. After the side shells 77 of the existing tanker 30 are re-welded, the reunited shorter tanker can even be floated out of the dry dock for final internal re-welding to be accomplished while the hull 31 is floating at quay side. Other structural uses of the existing tankers 30 are possible for the offshore platform 20 including but not limited to additional external boat impact fendering, external riser protection, additional external and internal watertight buoyancy bulkheads (vertical and horizontal), deck support, deck structural components, counterweight material containers, etc. Necessary components can be scavenged as desired during the construction process.

Depending on the primary mission of the platform 20, the newly formed hull 21 may require the addition of a moon pool (not shown) through the hull 21. The moon pool can be cut out as is done for other types of conventional floating offshore platform hulls. Water-tight bulkheads surrounding the moon pool, however, must have their smooth surfaces facing the seawater side of the moon pool. Therefore, some additional bulkhead rotation may result if a moon pool is needed. Moon pools, however, greatly reduce a hull's buoyancy at a very favorable location to have buoyancy, thus, the preferred embodiment of the present invention instead allows passage of the risers 33 individually through the hull 21 without the need for a moon pool. Referring to FIG. 6, this embodiment includes cutting a plurality of risers slot apertures 35 in the central section of the bottom 25 of the hull 21 and a corresponding plurality of riser slot apertures 37 in the top 23 of the hull 21 axially positioned in a matching relationship above the plurality of risers slot apertures 35 in the bottom 25 of the hull 21. As stated previously, riser pipe guide sleeves 39 can then be passed through the plurality of bottom and top riser slot apertures 35, 37 (FIG. 9). Each of the riser guide sleeves 39 can then be preferably welded and sealed to at least their respective bottom riser slot aperture 35. Weld sealing is preferred but other sealing methodologies as known by those skilled in the art are within the scope of the present invention. Sealing the bottom of the hull 21 to riser guide sleeves 39 is accomplished to thereby not lose the amount of buoyancy that a moon pool would have lost or the amount of buoyancy that would have been lost to the compartments 71 affected by cutting the riser slot apertures 35.

The above described hull configuration can support import, export and direct vertical access (DVA) risers to and from the hull using conventional systems of riser supports as known by those skilled in the art. This hull configuration can also support bottom tensioned risers which are supported vertically from the hull 21 and are tensioned near the seabed by a seabed counterweight (not shown). Risers such as those shown in FIG. 9 can be installed to be supported horizontally and vertically at the hull 21 or at the hull counterweight 55. The vertical support provided to the risers 33 can correspondingly provide additional stability to platform 20. The preferred configuration, as shown in FIG. 8, can provide vertical and horizontal support to a combination of import, export and DVA risers around a central column such as a tension access shaft 45. Tendon supports (not shown) can be added along the length of the tendon access shaft 45 (described below) to provide lateral support to the plurality of risers 33 at various depths below the hull 21 which can be very useful in reducing vortex induced vibration in these risers 33 as a result of deepwater currents.

Referring to FIGS. 6 and 8, the new hull 21 may require the right angle corners 95 formed from the two sections 87, 89, formed by the cuts 83, 85, and rejoined to form the new buoyant hull 21 (FIG. 5), to be removed (cut) to further improve the hydrodynamics of hull 21. Side shells 77 or watertight bulkheads 79 are then added, as shown, from other sections of the existing tanker 30 to close the openings caused by the removal of corners 95. FIG. 8 depicting hull 21 with eight sides is the result of cutting corners 95 from hull 21 shown in FIG. 6.

The hull 21 may require additional internal vertical bulkheads, such as bulkheads 79, be added. In fact, the hull 21 may require additional vertical or horizontal bulkheads to further increase the number of water tight compartments in the hull 21. The number of required watertight bulkheads may depend on the flooded compartment criteria that must be met by the design. For example, the normal damaged criteria for offshore platforms is for one compartment to be flooded and the hull and mooring system not be overstressed with an associated design storm event. The addition of the bulkheads 79 can be accomplished by obtaining the bulkhead material from, for example, other tanker sections 31, cutting the bulkhead material to form the new bulkhead sized to fit in the new hull 21, cutting slots in the top 23 (deck) of the new hull 21, and lowering the new bulkhead through slots cut in the top 23. Once the new bulkheads are in place, each affected bulkhead should be re-welded to preferably at least its original strength and should be made watertight.

The cargo tank section design of the new hull may also require additional stabilization. There are two preferred methods of stabilizing new hull 21. The first includes the addition of the tendon access shaft 45 as shown in FIGS. 6 and 9 including an associated counterweight 55, tendon access shaft extension 49, tendon connection aperture 53 and tendon supports (not shown). Referring to FIG. 6, a tendon access aperture 41 can be cut in the bottom 25 of the hull 21, by means known to those skilled in the art, and preferably substantially in a central portion. Correspondingly, another tendon access aperture 43 can be cut in the top 23 of the hull 21, also substantially in a central portion, and positioned axially in line with the aperture 41 in the bottom 25 of the hull 21. A tendon access shaft 45, generally in the form of a column though capable of being formed of different geometric variations, can then be positioned between the top and bottom apertures 41, 43. Preferably a section of the tendon access shaft 45 positioned adjacent the bottom 25 of the new hull 21 is weld sealed to the bottom 25 of the hull 21 to, as with the riser guide sleeves 39, provide watertight buoyancy to the hull 21. The top 23 of the hull 21 may or may not be connected such that connection forms a watertight connection.

Figure 11:
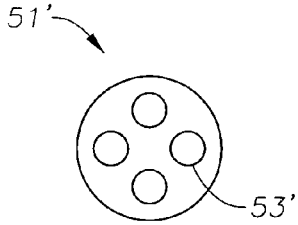
FIG. 11 is a plan view of an alternative tendon axis shaft extension according to an embodiment of the present invention.

Referring to FIG. 9, the length of the tendon access shaft 45 can be selected such that the tendon access shaft 45 extends below the bottom 25 of the hull 21. The tendon access shaft 45 can extend even further by attaching a tendon access shaft extension 49 to the tendon access shaft 45 or by installing a unitary combined tendon access shaft 45 including the tendon access shaft extension 49. The tendon access shaft 45 can also support one or more tendons 47. These tendons 47 can be used to moor the new hull 21 to its site specific location. A tendon connector 51 can be attached to the lower end of the tendon access shaft extension 49 to provide for the connection of the tendons 47. In the configuration shown in FIGS. 9 and 10, the tendon connector 51 provides a single aperture 53. The upper end of a single tendon 47 is attached through the aperture 53 of the tendon connector 51. The tendon 47 is preferably connected by a flex joint or similar means as known by those skilled in the art. Alternatively, as shown in FIG. 11, the tendon connector 51' can provide a plurality of apertures 53' to connect additional tendons. Additional tendons increase tendon redundancy and help reduce the size of the individual tendons and flex joints to allow the use of conventionally sized tendons and flex joints.

Referring again to FIG. 9, if even additional stability is desired, a counterweight 55 can be added below the buoyant hull 21. The counterweight 55 can be connected to the lower portion of the tendon access shaft 45 by a means known by those skilled in the art. Because the extended tendon access shaft 45, which may include a shaft extension 49, provides an additional righting arm, the resulting attachment of a counterweight 55 and/or tendon 47 to the bottom of the tendon access shaft extension 49 will significantly increase the overturning moment resistance of the platform 20 and thus increase the stability of the hull 21. The size and the length of the tendon access shaft 45 and the weight of the counterweight 55 can be selected such that the counterweight 55 can provide adequate free floating stability of the platform 20 in the event of tendon failure. Additionally, the riser conductor slots 57 can be made in the counterweight 55, by means as known to those skilled in the art, to provide lateral stability to a plurality of risers 33 and to allow passage of the risers 33 closely adjacent the tendon access shaft 45 or shaft extension 49.

The second method of stabilizing the platform 20 can include increasing the draft of the new hull 21 above that designed for the cargo tank section 31 of the oil tanker 30. This can be accomplished by adding additional compartments such as compartments 61 (FIG. 12) under what was the baseline of the hull of the existing tanker 30. These additional compartments 61 can also be made from existing portions of the existing tanker 30 or from new construction. If these additional compartments 61 will be void in the installed offshore platform 20, additional side-shell internal stiffeners may need to be added to the additional compartments 61 to resist the greater hydrostatic pressure of the deeper draft compartment 61. If these new compartments will not be subject to significant hydrostatic pressures increases because they will be flooded at all times, the original portion of the tanker or original tanker design used to make these new compartments may be able to be used without modification or additional stiffening.

Primarily, the above discussion with regard to constructing the multi-flat sided floating offshore platform 20 was with reference to using existing cargo tank sections 31 of an existing oil tanker 30. However, use of a newly constructed hull material is within the scope of the present invention. There are, however a few differences. For example, instead of extracting an intact cargo tank section 31, with new construction individual plates or bulkheads can be cut to build the hull 21 in a form similar to that of a cargo tank section 31 but with a draft selected by the user, and additional flat plates used to build additional bulkheads can be manufactured to the proper size. The use of new construction allows the plan and elevation dimensions of the new hull to be varied from traditional tanker dimensions to provide more efficient compartmentalization, hydrodynamics, and stability. For example, if an eight- or twelve-sided hull is desired, plates can be manufactured directly to fit the desired structure rather than forming a four sided structure such as that shown in FIG. 6 and then cutting the corners of the structure to add additional plates or sideshells/bulkheads to form the additional sides.

Figure 12:
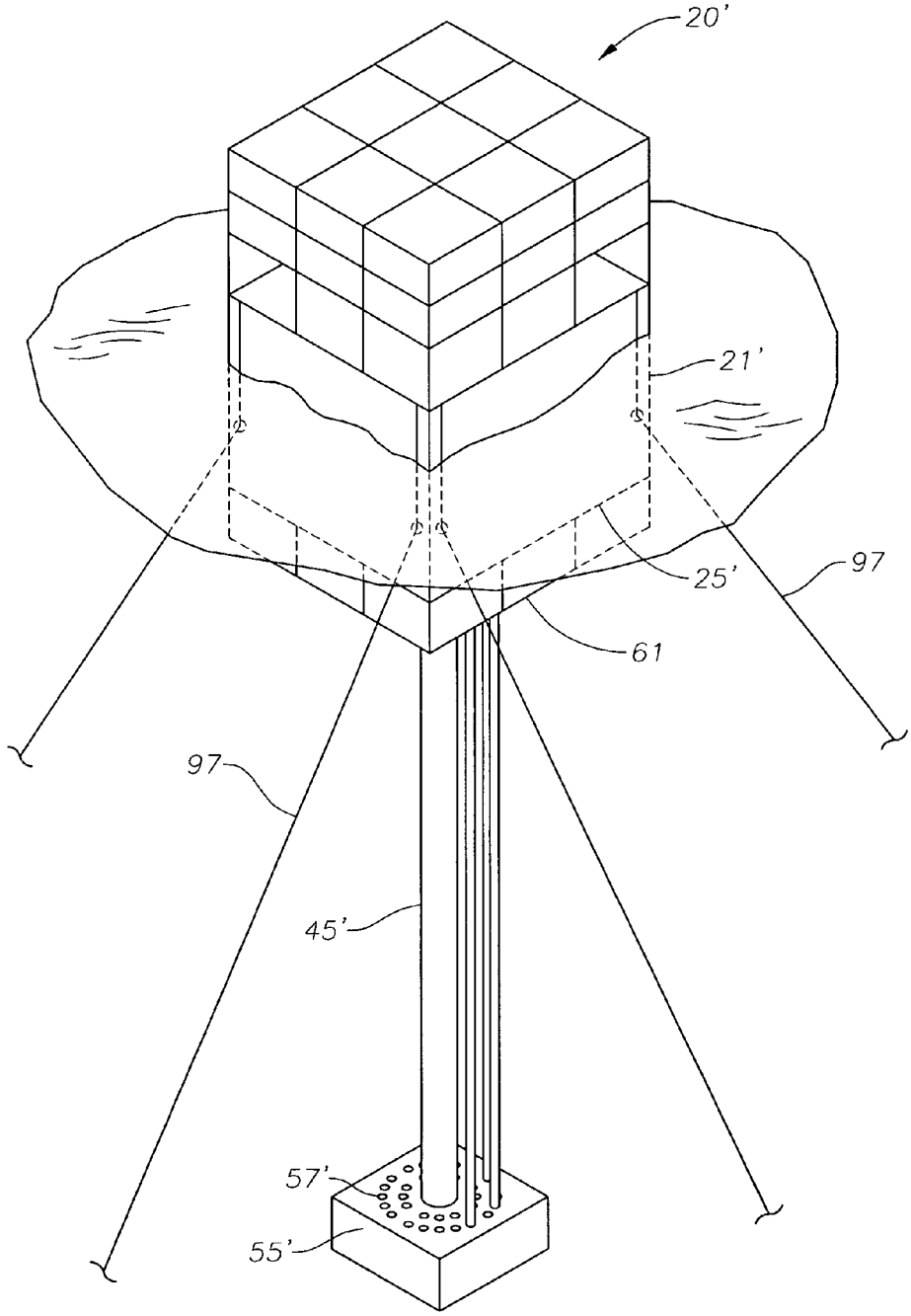
FIG. 12 is a perspective view of an alternative embodiment of the present invention.

Referring to FIG. 12, new construction based on cargo tank design for an oil tanker 30, or through the addition of additional compartments 61 below the bottom 25 of a hull 21 formed of an existing cargo tank section 31 (FIG. 6 or 8) can yield a resultant platform 20' designed with an increased draft such as that shown. In this embodiment, a counterweight support shaft 45' similar to the tendon access shaft (described above) can be installed to carry a counterweight 55' to provide additional hull stability. As described with respect to a previous embodiment, riser conductor slots 57' can be formed in the counterweight 55' in order to provide lateral support to a plurality of risers (not shown). Additionally, the risers can be interfaced with the counterweight 55' by means known to those skilled in the art to support the vertical load of the risers at the counterweight 55' and to provide additional platform stability. In this embodiment, and in those previously described, instead of tension legs connected to the counterweight support shaft, a plurality of mooring connectors 97 can instead be attached to a plurality of sides 27' of the new hull 21', preferably below the design center of buoyancy. The mooring cables 97 such as spread moored catenary anchor legs can be connected to seabed anchors in a spread pattern with the upper end of the anchor legs attached preferably to the hull in a way known by those skilled in the art.

The invention has several advantages. An embodiment of the present invention shows how to remove one or more near intact portions of cargo tanks of an existing "thin-skinned" oil tanker and how to modify the removed section to support a deck and desired payload. Use of an existing oil tanker saves the cost of new steel, the cost of labor and equipment to turn the new steel into a new hull. It also saves the time in the project schedule for associated new hull engineering, procurement, and fabrication activities. Use of an existing tanker can save dry dock time and the cost of new construction. The desired section of a tanker could be cut free from the existing tanker in less than 4 days in a dry dock. The resulting shorter tanker could even continue to serve as a tanker or can be steamed to the scrap yard. Since the resulting new offshore platform hull was originally part of an oil tanker, it would be a low cost option to arrange for the new offshore platform's hull to store oil, regulations permitting. Additionally, the new hull could also be used for exploration drilling since it can laterally support the drilling riser through significant deepwater currents, support significant topside loads, including a drilling rig and store significant amounts of liquids in the hull. Additionally, the new hull could also be used for non-petroleum industry purposes such as an offshore military base, an offshore hotel, an offshore power plant, a floating wind generator support, an ocean thermal generation power plant, a floating harbor, or a deep ocean mining platform, just to name a few.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification. For example, other embodiments of the present invention can use more of the existing oil tanker's flat stiffened panels to add more internal vertical and horizontal bulkheads and external side shells to the intact or nearly intact cargo tank section of the existing tanker to make the new offshore platform's hull. Also, existing oil tanker sections can be combined with newly fabricated sections in making the final hull.

What is claimed is:

1. An offshore platform, comprising:

a buoyant hull having a top, a bottom, and a plurality of substantially flat sides extending between the top and the bottom to form a hull interior, the bottom of the hull including a first aperture positioned substantially in a central portion of the bottom of the hull to thereby define a first tendon access shaft aperture, the top of the hull including a second aperture positioned substantially in a center portion of the top of the hull to thereby define a second tendon access shaft aperture, a conduit extending between the first tendon access shaft aperture and the second tendon access shaft aperture to thereby define a tendon access shaft, the bottom of the hull sealed about the tendon access shaft to prevent loss of buoyancy for the hull interior, and a tendon extending into the tendon access shaft to moor the hull to a site specific location.

2. The platform of claim 1, wherein the buoyant hull further includes:

a plurality of smaller apertures positioned in a surrounding relationship to the first tendon access shaft aperture to thereby define a plurality of bottom riser slot apertures;

a corresponding plurality of smaller apertures positioned in a surrounding relationship to the second tendon access shaft aperture to thereby define a plurality of top riser slot apertures; and a plurality of riser guide sleeves positioned between the top riser slot apertures and the bottom riser slot apertures, the bottom of the hull sealed about the riser guide sleeves to prevent loss of buoyancy for the hull interior.

3. The platform of claim 2, further comprising a counterweight connected to the lower portion of the tendon access shaft and having a plurality of riser conductor slots extending therethrough to provide lateral stability to a plurality of risers extending through the plurality of riser conductor slots.

4. The platform of claim 1, further comprising a plurality of water tight compartments connected to the bottom of the buoyant hull to provide adequate buoyancy and stability in the event of watertight compartment flooding.

5. The platform of claim 1, further comprising:

production equipment positioned within the hull interior to enhance stability of the hull and to process well fluid; and a conduit extending from the production equipment to a subsea well facility.

6. An offshore platform, comprising:

a buoyant hull having a substantially flat top, and substantially flat bottom, and a plurality of substantially flat sides, the bottom of the hull including a first aperture positioned substantially in a central portion of the bottom of the hull to thereby define a first tendon access shaft aperture, a plurality of smaller apertures positioned in a surrounding relationship to the first tendon access shaft aperture to thereby define a plurality of bottom riser slot apertures, the top of the hull including a second aperture positioned substantially in a center portion of the top of the hull to thereby define a second tendon access shaft aperture, and a corresponding plurality of smaller apertures positioned in a surrounding relationship to the second tendon access shaft aperture to thereby define a plurality of top riser slot apertures, the second tendon access shaft aperture positioned in a matching actual relationship with the first tendon access shaft, and the top riser slot apertures positioned in a matching axial relationship with the bottom riser slot apertures;

a conduit having an upper portion and a lower portion and extending from below the bottom of the hull and through the first and second tendon access shaft apertures to thereby define a tendon access shaft, the upper portion of the tendon access shaft cooperatively engaged with the hull to provide access to a tendon;

a counterweight connected to the lower portion of the tendon access shaft and having a plurality of riser conductor slots to provide lateral stability to a plurality of risers; and wherein the counterweight has a plurality of riser conductor slots connected to a plurality of risers to support a vertical load of the risers and provide additional vertical stability to the offshore platform and the risers.

7. An offshore platform, comprising:

a buoyant hull having a substantially flat top, and substantially flat bottom, and a plurality of substantially flat sides the bottom of the hull including a first aperture positioned substantially in a central portion of the bottom of the hull to thereby define a first tendon access shaft aperture, a plurality of smaller apertures positioned in a surrounding relationship to the first tendon access shaft aperture to thereby define a plurality of bottom riser slot apertures, the top of the hull including a second aperture positioned substantially in a center portion of the top of the hull to thereby define a second tendon access shaft aperture and a corresponding plurality of smaller apertures positioned in a surrounding relationship to the second tendon access shaft aperture to thereby define a plurality of top riser slot apertures, the second tendon access shaft aperture positioned in a matching actual relationship with the first tendon access shaft, and the top riser slot apertures positioned in a matching axial relationship with the bottom riser slot apertures;

a conduit having an upper portion and a lower portion and extending from below the bottom of the hull and through the first and second tendon access shaft apertures to thereby define a tendon access shaft, the upper portion of the tendon access shaft cooperatively engaged with the hull to provide access to a tendon;

a counterweight connected to the lower portion of the tendon access shaft and having a plurality of riser conductor slots to provide lateral stability to a plurality of risers; and wherein the tendon access shaft further includes a tendon access shaft extension to extend the distance of the counterweight from the bottom of the hull to provide additional stability to the platform such that the platform floats vertically without the need of additional subsea support.

8. The platform of claim 7, wherein the tendon access shaft extension includes a tendon connector having a connection aperture for connecting a single tendon.

9. The platform of claim 7, wherein the tendon access shaft extension includes a tendon connector having a plurality of tendon connection apertures for connecting a plurality of tendons.

10. A method of constructing an offshore platform, comprising the steps of:

removing an intact midsection oil cargo tank from an existing tanker;

removing an inner portion of the removed oil cargo tank section, separating the oil cargo tank section into a plurality of separate sub-sections; and rejoining the separate subsections to form a buoyant hull having a top, a bottom, and a plurality of flat sides, the hull having a width and length that are substantially the same.

11. A method of claim 10, further comprising the step of removing and rotating bulkheads forming sides of the hull such that bulkhead stiffeners are on the inside of said hull.

12. A method of claim 10, further comprising the steps of:

forming an aperture in the bottom and an aperture in the top aligned with the aperture in the bottom; and securing a conduit sealingly between the apertures.

13. A method of claim 10, further comprising the steps of:

forming a plurality of first riser slot apertures in a central section of the bottom of the new hull and forming a plurality of second riser slot apertures in the top of the new hull axially positioned in a matching relationship above the plurality of first riser slot apertures and installing a corresponding plurality of riser guide sleeves between the first and second riser slot apertures; and forming a first tendon access shaft aperture in a central section of the bottom of the new hull and forming a second tendon access shaft aperture in the top of the new hull axially positioned in a matching relationship above the first tendon access shaft aperture and installing a tendon access shaft having a tendon access shaft extension between the first and second tendon access shaft apertures with the tendon access shaft extension extending below the bottom of the new hull.

14. The method of claim 13, further comprising the step of attaching a counterweight to a lower end of the tendon access shaft.

15. The method of claim 10, further comprising the step of removing corners of the hull and adding side panels at the corners to form an at least eight-sided hull.

16. A method of constructing an offshore platform, comprising the steps of:

forming a buoyant hull having a top, a bottom, and a plurality of substantially flat sides extending between the top and the bottom to form a hull interior;

forming a first tendon access shaft aperture in a central section of the bottom of the hull;

forming a second tendon access shaft aperture in the top of the hull axially positioned in a matching relationship above the first tendon access shaft aperture;

installing a tendon access shaft having a tendon access shaft extension between the first and second tendon access shaft apertures with the tendon access shaft extension extending below the bottom of the hull;

sealing the bottom of the hull about the tendon access shaft to prevent loss of buoyancy for the hull interior; and connecting a tendon to the tendon access shaft to moor the hull to a site specific location.

17. The method of claim 16, further comprising the steps of:

forming a plurality of first riser slot apertures in a central section of the bottom of the hull;

forming a plurality of second riser slot apertures in the top of the hull axially positioned in a matching relationship above the plurality of first riser slot apertures;

installing a corresponding plurality of riser guide sleeves between the first and second riser slot apertures; and sealing the bottom of the hull about the riser guide sleeves to prevent loss of buoyancy for the hull interior.

18. The method of claim 17, further comprising the step of:

attaching to a lower end of the tendon access shaft a counterweight having a plurality of riser conductor slots to provide lateral stability to a plurality of risers extending from the buoyant hull.

19. A method of forming and using an offshore platform, comprising the steps of:

cutting a tank section or sections from a tanker to define a hull;

installing production equipment placed within an interior of the hull to enhance stability of the hull;

mooring the hull;

connecting a conduit from a subsea well facility to the production equipment;

flowing well fluid to the production equipment and processing the well fluid; and then discharging the well fluid from the production equipment.

20. The method of claim 19, further comprising the steps of:

installing in the hull a tendon access shaft having a tendon access shaft extension extending below a bottom of the hull; and connecting a tendon to the tendon access shaft extension to provide mooring for the hull.

21. The method of claim 20, further comprising the step of:

attaching to a lower end of the tendon access shaft a counterweight to provide additional stability to the offshore platform so that the offshore platform floats substantially vertically without the need of additional subsea mooring support.

22. The method of claim 20, further comprising the step of:

attaching to the tendon access shaft a tendon connector having a connection aperture for connecting a tendon to moor the hull.

23. The method of claim 19, further comprising the step of:

removing corners of the hull and adding side panels at the corners to form an at least eight-sided hull.

24. A method of constructing an offshore platform, comprising the steps of:

cutting and removing one or more intact midsection oil cargo tanks from an existing tanker to form a buoyant hull having a top, a bottom, a plurality of substantially flat sides, and a plurality of watertight bulkheads; and adding additional watertight bulkheads to the buoyant hull to increase a number of watertight compartments.

* * * * *